US008995888B2

(12) United States Patent
Eto

(10) Patent No.: US 8,995,888 B2
(45) Date of Patent: Mar. 31, 2015

(54) IMAGE FORMING APPARATUS AND DEVELOPMENT DEVICE

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 121 days.

(21) Appl. No.: 13/749,104

(22) Filed: Jan. 24, 2013

(65) Prior Publication Data

US 2013/0195511 A1 Aug. 1, 2013

(30) Foreign Application Priority Data

Jan. 31, 2012 (JP) ..... 2012-019167

(51) Int. Cl.
*G03G 15/08* (2006.01)

(52) U.S. Cl.
CPC ..... *G03G 15/0898* (2013.01); *G03G 15/0877* (2013.01); *G03G 15/0886* (2013.01)
USPC ..... 399/260; 399/103; 399/106; 399/120; 399/258; 399/262

(58) Field of Classification Search
CPC ..... G03G 15/0886
USPC ..... 399/103, 106, 120, 258, 260, 262
See application file for complete search history.

(56) References Cited

U.S. PATENT DOCUMENTS 4,615,364 A 10/1986 Kawata
5,440,376 A * 8/1995 Hagihara ..... 399/120
6,564,029 B2 5/2003 Kojima et al.
2002/0034404 A1 3/2002 Kojima et al.
2002/0064401 A1* 5/2002 Ashikari ..... 399/258
2003/0142998 A1* 7/2003 Tanaka ..... 399/258
2004/0265010 A1* 12/2004 Otani ..... 399/258
2005/0196184 A1 9/2005 Koyama et al.
2007/0237551 A1* 10/2007 Kawai ..... 399/258
2012/0003000 A1 1/2012 Nishiyama et al.
2012/0257912 A1* 10/2012 Hasebe ..... 399/262

(Continued)

FOREIGN PATENT DOCUMENTS

EP 0098081 A2 1/1984
EP 1184741 A2 3/2002

(Continued)

OTHER PUBLICATIONS

The extended European search report issued on Jun. 28, 2013, which corresponds to EP13152176.7 and is related to U.S. Appl. No. 13/749,104.

(Continued)

*Primary Examiner* — Ryan Walsh
(74) *Attorney, Agent, or Firm* — Studebaker & Brackett PC

(57) ABSTRACT

An image forming apparatus includes a toner container and a development device. The toner container includes a container main body being provided with a discharge port configured to discharge a toner. The development device includes a development device main body being provided with a replenishment port configured to receive a toner discharged from the discharge port and a shutter configured to open/close the replenishment port. The shutter opens/closes the replenishment port by turning along the outside face of the development device main body.

16 Claims, 16 Drawing Sheets

(56) References Cited

U.S. PATENT DOCUMENTS

| | | | | |
|---|---|---|---|---|
| 2012/0263503 | A1* | 10/2012 | Nagashima | 399/262 |
| 2013/0078004 | A1* | 3/2013 | Matsumoto | 399/260 |

FOREIGN PATENT DOCUMENTS

| | | | |
|---|---|---|---|
| JP | S62-116970 | A | 5/1987 |
| JP | 62-262070 | A | 11/1987 |
| JP | 02-226268 | A | 9/1990 |
| JP | H08-286490 | A | 11/1996 |
| JP | 2000-330356 | A | 11/2000 |
| JP | 2002-091144 | A | 3/2002 |
| JP | 2005-134452 | A | 5/2005 |
| JP | 2008-083164 | A | 4/2008 |
| JP | 2012-13911 | A | 1/2012 |

OTHER PUBLICATIONS

Japanese Office Action Notification of Reasons for Rejection dated on Jun. 4, 2013, which corresponds to Japanese Patent Application No. 2012-019167 and is related to U.S. Appl. No. 13/749,104.

An Office Action; Notice of Reason for Rejection, issued by the Japanese Patent Office on Jul. 22, 2014, which corresponds to Japanese Patent Application No. 2013-231926 and is related to U.S. Appl. No. 13/749,104.

* cited by examiner

IMAGE FORMING APPARATUS AND DEVELOPMENT DEVICE

INCORPORATION BY REFERENCE

This application is based on and claims the benefit of priority from Japanese Patent application No. 2012-019167 filed on Jan. 31, 2012, the entire contents of which are incorporated herein by reference.

BACKGROUND

The present disclosure relates to an image forming apparatus and a development device installed therein.

An electrographic image forming apparatus has performed a developing process by supplying a toner (a developer) from a development device to an electrostatic latent image formed on a surface of a photosensitive drum or the like. The toner used in such a developing process is supplied to the development device from a toner container detachably attached onto the development device. The development device is then provided with a replenishment port for receiving the toner from the toner container. The replenishment port generally may be covered by an openably/closably shutter.

The aforementioned shutter mechanism is illustrated in FIG. 16. A shutter 121 is provided with an inclined plane 122 inclined to diagonally upward and formed with a roughly triangle profile in a side view. The shutter 121 can be linearly slid between one position (refer to a two-dot chain line) to close a replenishment port 124 formed on a development device 123 and another position (refer to a solid line) to open the replenishment port 124. When a toner container (not shown) is not attached onto the development device 123, the shutter 121 is biased to one position to close the replenishment port 124 by a pair of coil springs 125 attached on both sides of the replenishment port 124.

In this situation, when the toner container (not shown) is attached onto the development device 123 from above as indicated by an arrow in FIG. 16, the toner container presses the inclined plane 122 of the shutter 121 from the upper side. Then, the shutter 121 linearly slides from one position to close the replenishment port 124 to another position to open the replenishment port 124.

However, in such a configuration of using the linearly slidable shutter, it is necessary to locate biasing members, such as the coil springs, onto both sides of the replenishment port in order to secure operation stability of the shutter, that is, a plurality of the biasing members are needed. It is therefore feared that the number of components and manufacturing costs increase.

SUMMARY

In accordance with an embodiment of the present disclosure, an image forming apparatus includes a toner container and a development device. The toner container includes a container main body. The container main body is provided with a discharge port configured to discharge a toner. The development device includes a development device main body and a shutter. The development device main body has a replenishment port configured to receive a toner discharged from the discharge port. The shutter opens/closes the replenishment port by turning along the outside face of the development device main body.

Furthermore, in accordance with an embodiment of the present disclosure, a development device is installed into an image forming apparatus together with a toner container. The toner container includes a container main body provided with a discharge port configured to discharge a toner. The development device includes a development device main body and a shutter. The development device main body has a replenishment port configured to receive a toner discharged from the discharge port. The shutter opens/closes the replenishment port by turning along the outside face of the development device main body.

Moreover, in accordance with the present disclosure, a development device includes a development device main body and a shutter. The development device main body has a replenishment port configured to receive a toner. The shutter opens/closes the replenishment port by turning along the outside face of the development device main body.

The above and other objects, features, and advantages of the present disclosure will become more apparent from the following description when taken in conjunction with the accompanying drawings in which a preferred embodiment of the present invention is shown by way of illustrative example.

DETAILED DESCRIPTION

First Embodiment

Figure 1:
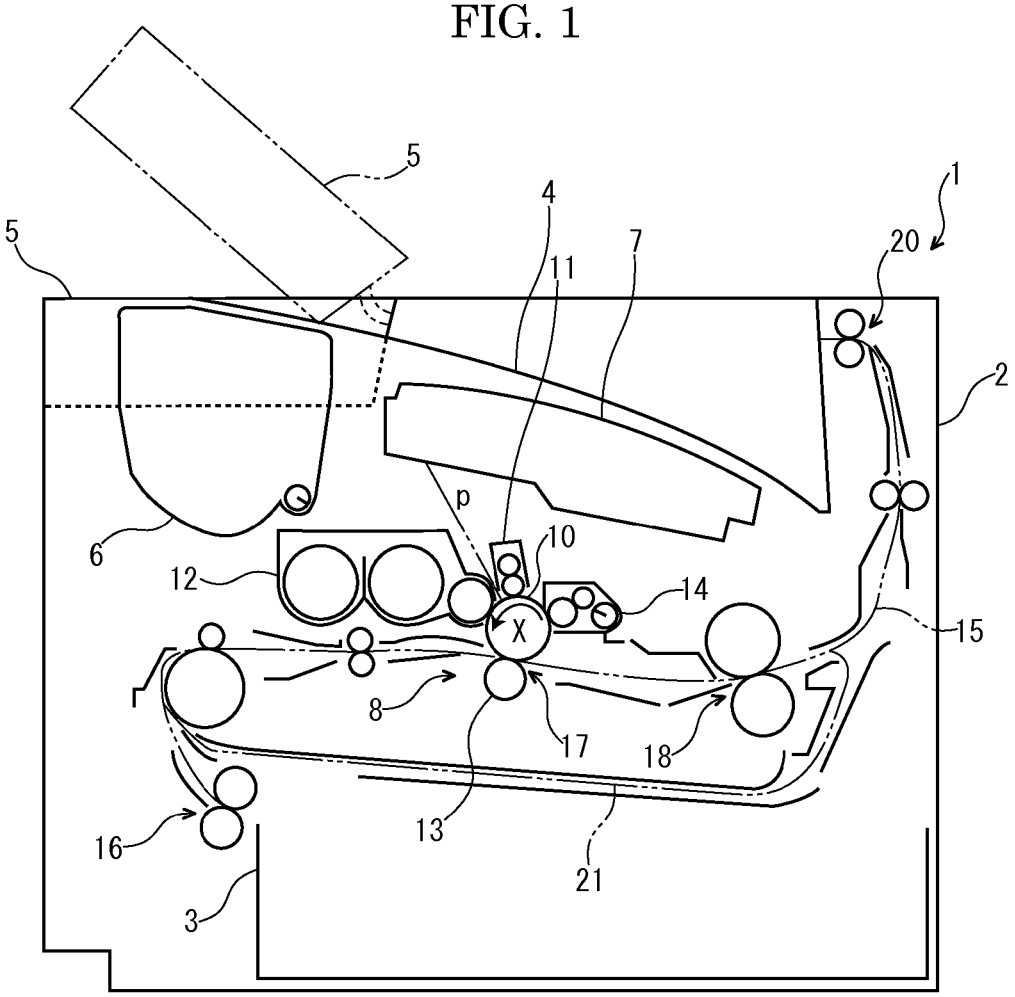
FIG. 1 is a schematic diagram schematically showing a printer according to a first embodiment of the present disclosure.

With reference to FIG. 1, the entire structure of an electrographic printer 1 as an image forming apparatus will be described. FIG. 1 is a schematic diagram schematically showing the printer according to a first embodiment of the present disclosure. Hereinafter, it will be described so that the front side of the printer 1 is positioned at the left-hand side of FIG. 1.

The printer 1 includes a box-formed printer main body 2. In a lower part of the printer main body 2, a sheet feeding cartridge 3 for storing sheets (not shown) is installed and, on the top surface of the printer main body 2, a sheet ejecting tray 4 is mounted. On the top surface of the printer main body 2, an upper cover 5 is openably/closably attached at the front of sheet ejecting tray 4 and, below the upper cover 5, a toner container 6 as a toner case is installed.

In an upper part of the printer main body 2, an exposure device 7 is installed below the sheet ejecting tray 4. The exposure device 7 is composed of a laser scanning unit (LSU). Below the exposure device 7, an image forming unit 8 is installed. In the image forming unit 8, a photosensitive drum 10 as an image carrier is rotatably attached. Around the photosensitive drum 10, a charger 11, a development device 12, a transfer roller 13 and a cleaning device 14 are located along a rotating direction (refer to arrow X in FIG. 1) of the photosensitive drum 10.

In the printer main body 2, a sheet conveying path 15 is arranged. At an upper stream end of the conveying path 15, a sheet feeder 16 is positioned and, at an intermediate stream part of the conveying path 15, a transferring unit 17 constructed of the photosensitive drum 10 and the transfer roller 13 is positioned. Furthermore, at a lower stream part of the conveying path 15, a fixing device 18 is positioned and, at a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
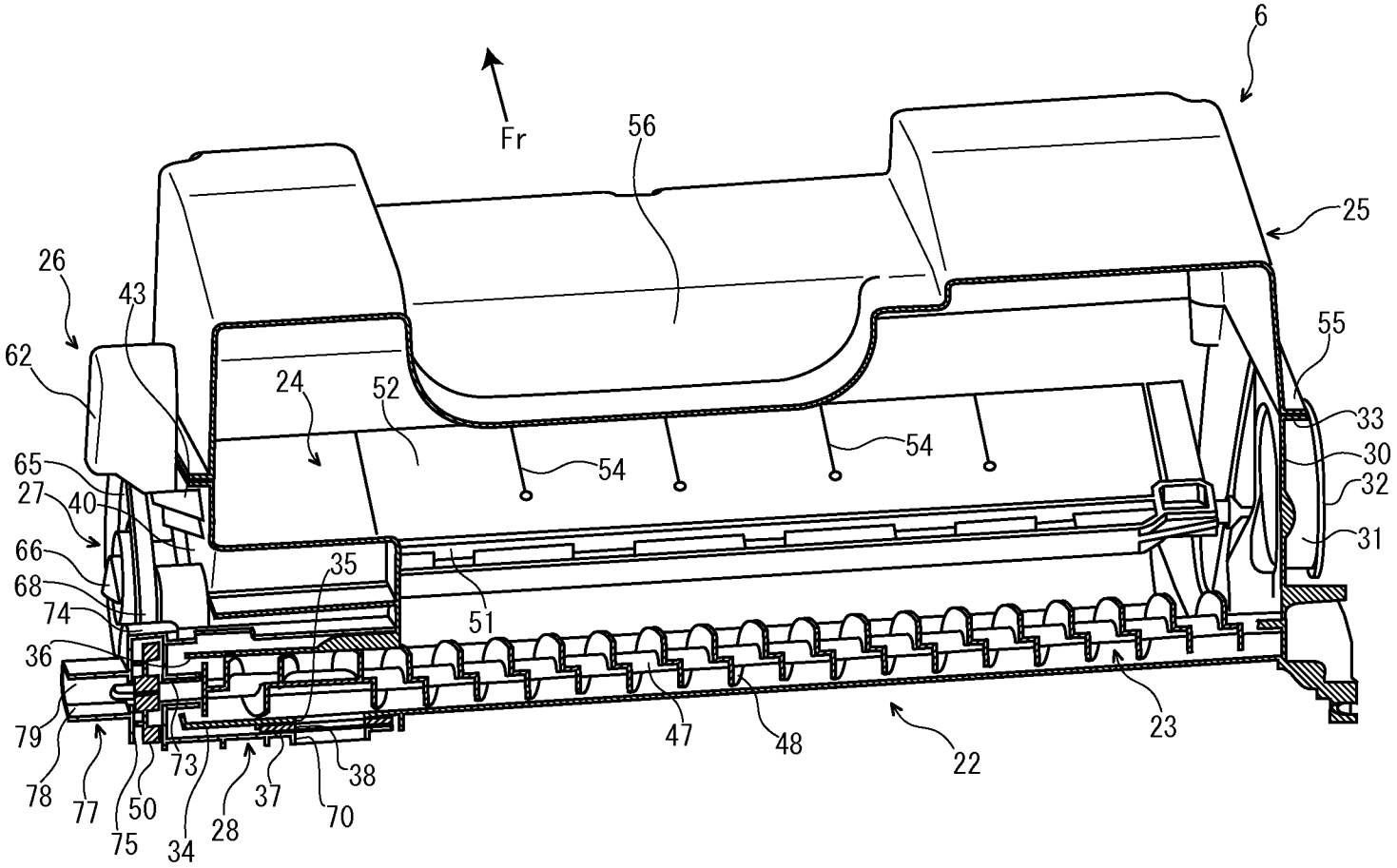
FIG. 2 is a back perspective sectional view showing a toner container in the printer according to the first embodiment of the present disclosure.
Figure 3:
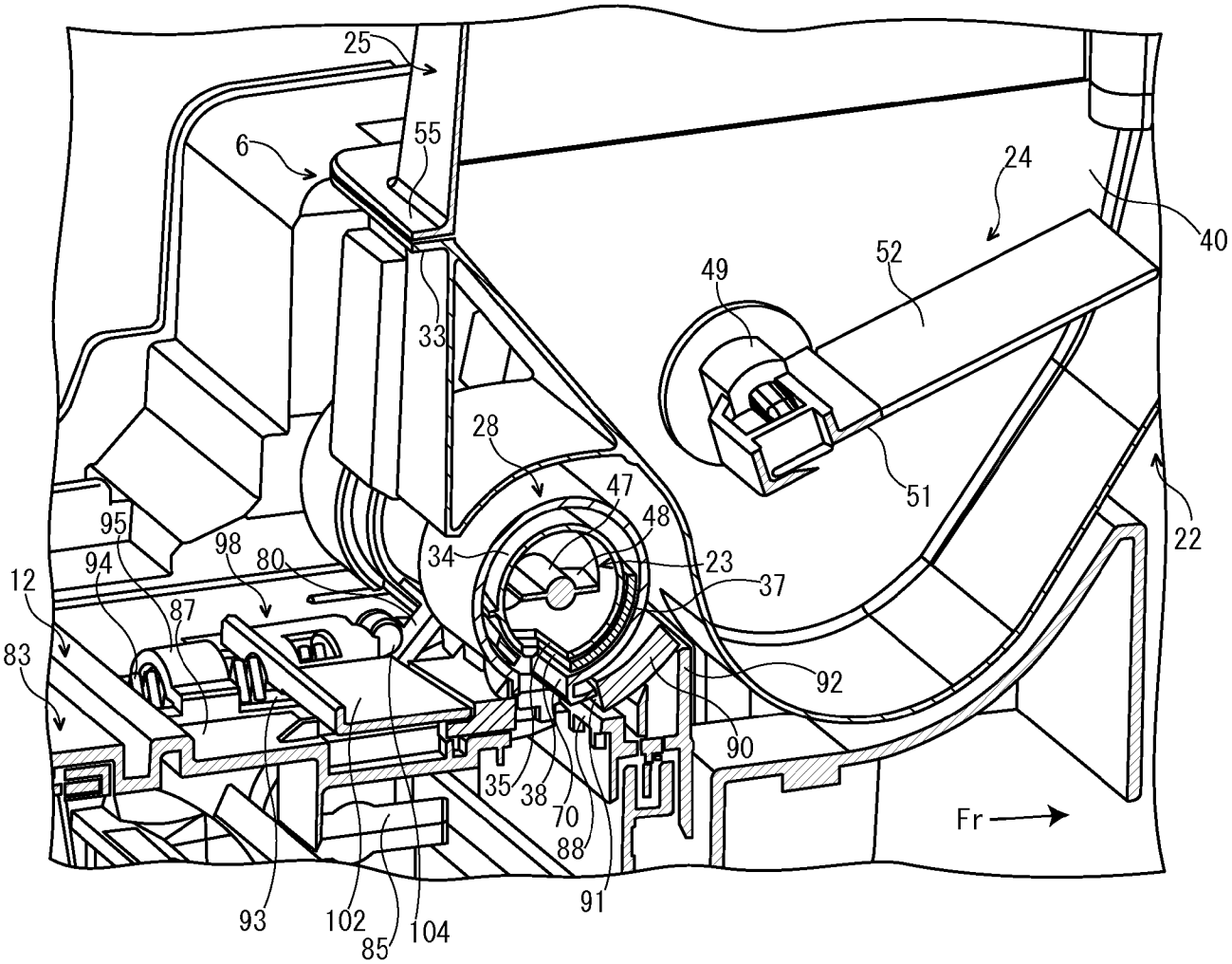
FIG. 3 is a back left perspective sectional view showing the printer in a situation, in which a container side shutter opens a discharge port and a development device side shutter opens a replenishment port, according to the first embodiment of the present disclosure.
Figure 4:
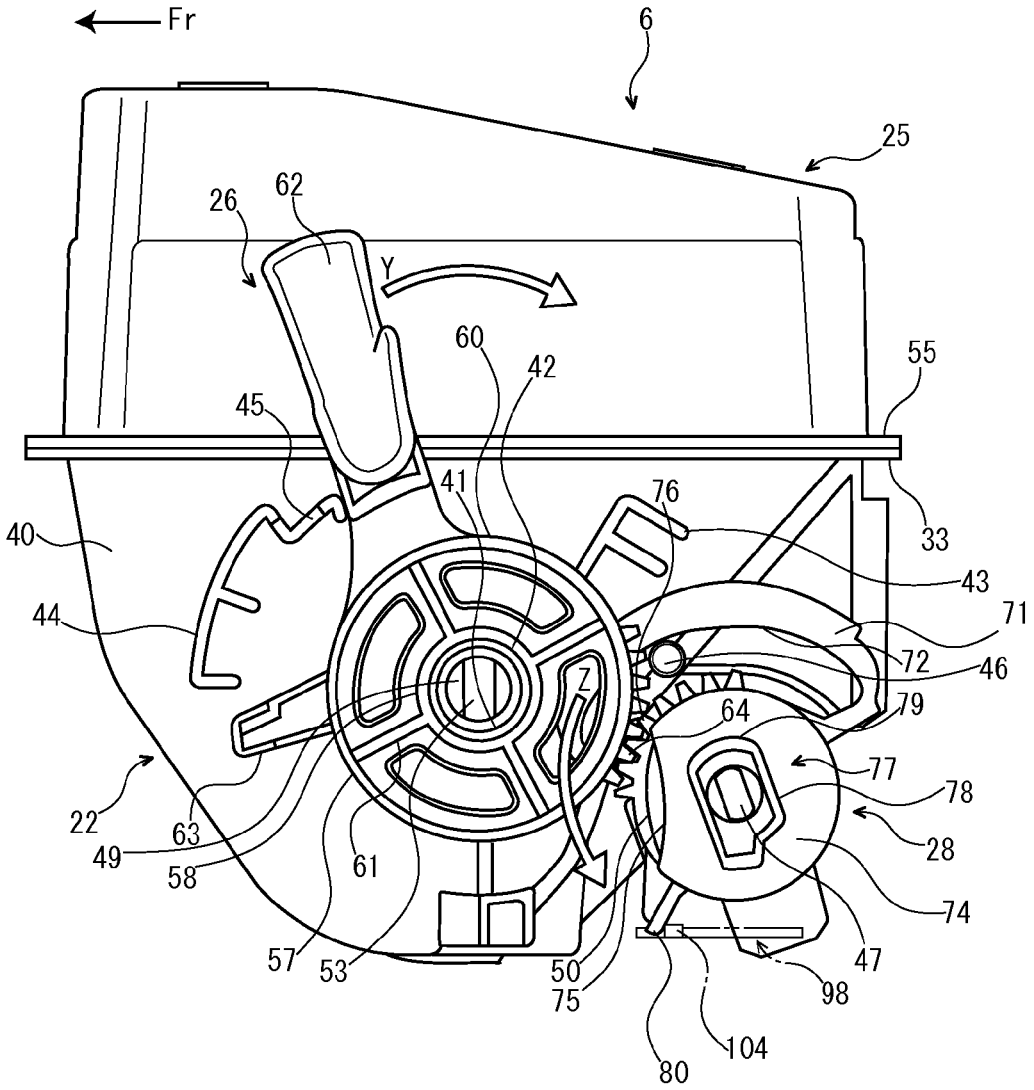
FIG. 4 is a right side view showing the toner container of the printer in a situation, in which a gripper of a lever is tilted forward, according to the first embodiment of the present disclosure.
Figure 5:
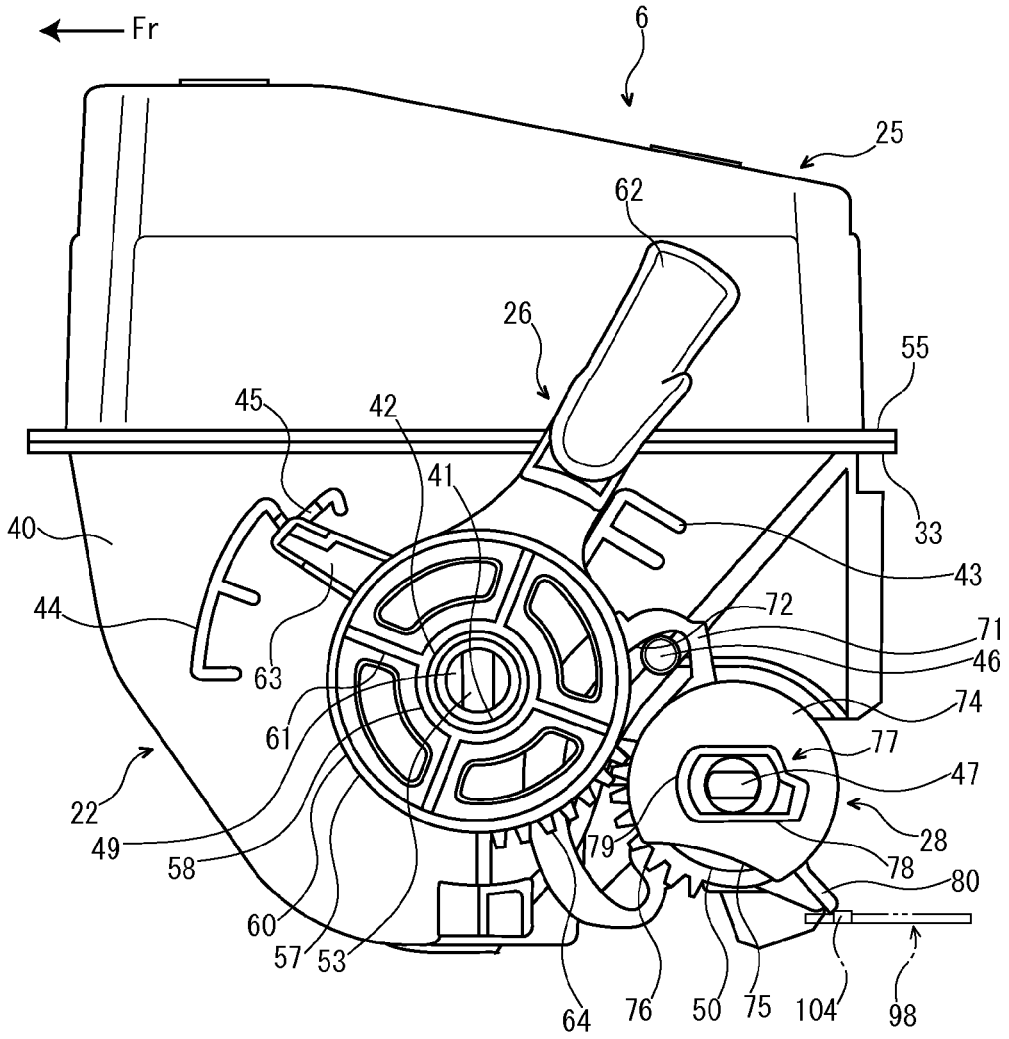
FIG. 5 is a right side view showing the toner container of the printer in a situation, in which the gripper of the lever is tilted backward, according to the first embodiment of the present disclosure.
Figure 6:
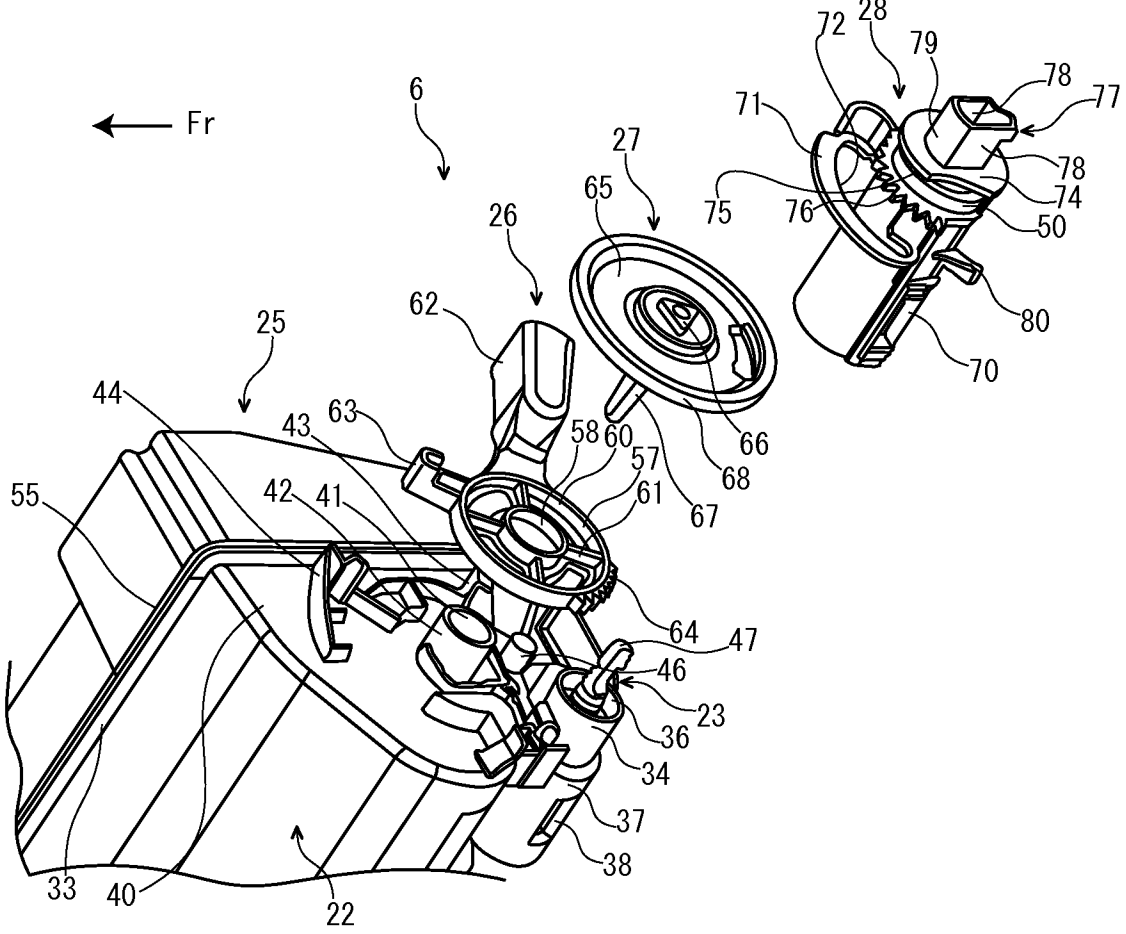
FIG. 6 is an exploded perspective view showing the toner container in the printer according to the first embodiment of the present disclosure.
Figure 7:
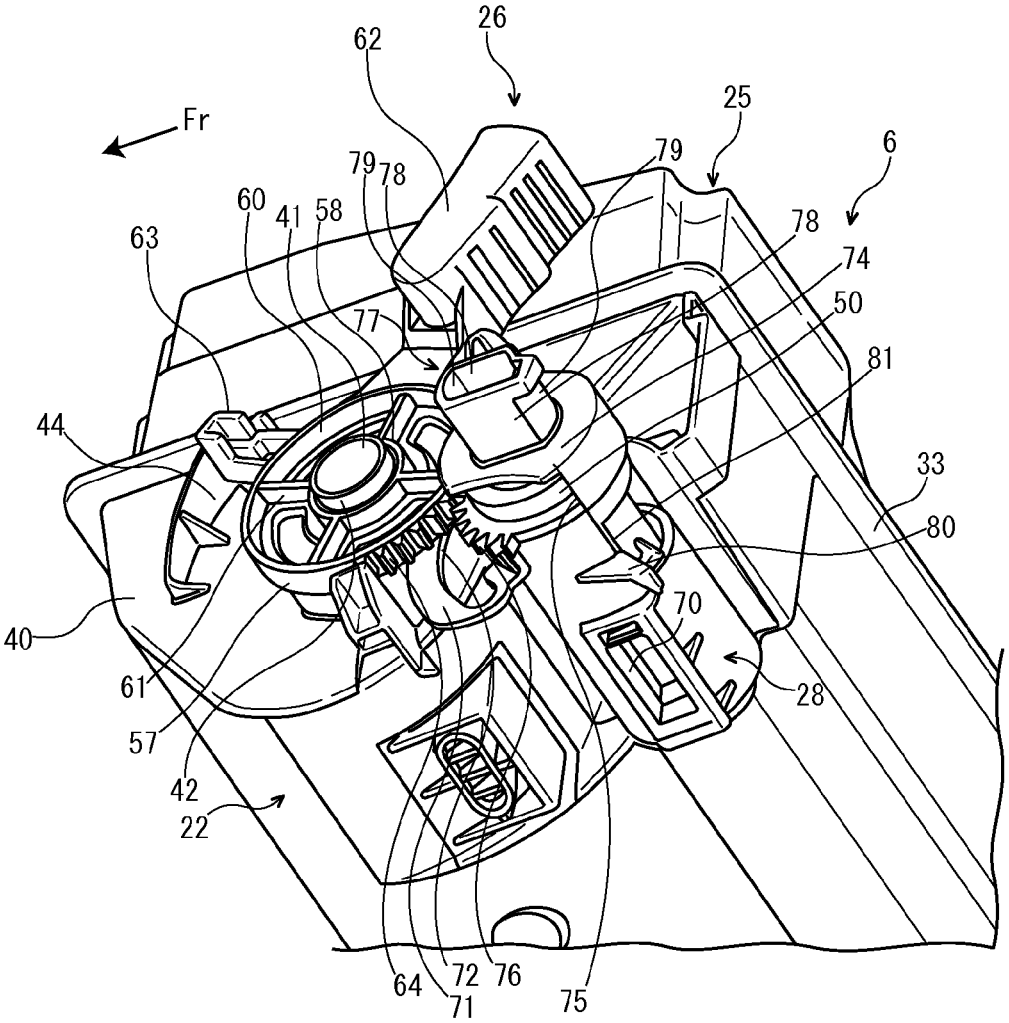
FIG. 7 is a right bottom perspective view showing the toner container in the printer according to the first embodiment of the present disclosure.

Next, mainly with reference to FIGS. 2-7, the toner container 6 will be described in detail. FIG. 2 is a back perspective sectional view showing the toner container in the printer according to the first embodiment of the present disclosure. FIG. 3 is a back left perspective sectional view showing the printer in a situation, in which a container side shutter opens a discharge port and a development device side shutter opens a replenishment port, according to the first embodiment of the present disclosure. FIG. 4 is a right side view showing the toner container of the printer in a situation, in which a gripper of a lever is tilted forward, according to the first embodiment of the present disclosure. FIG. 5 is a right side view showing the toner container of the printer in a situation, in which the gripper of the lever is tilted backward, according to the first embodiment of the present disclosure. FIG. 6 is an exploded perspective view showing the toner container in the printer according to the first embodiment of the present disclosure. FIG. 7 is a right bottom perspective view showing the toner container in the printer according to the first embodiment of the present disclosure.

Figure 8:
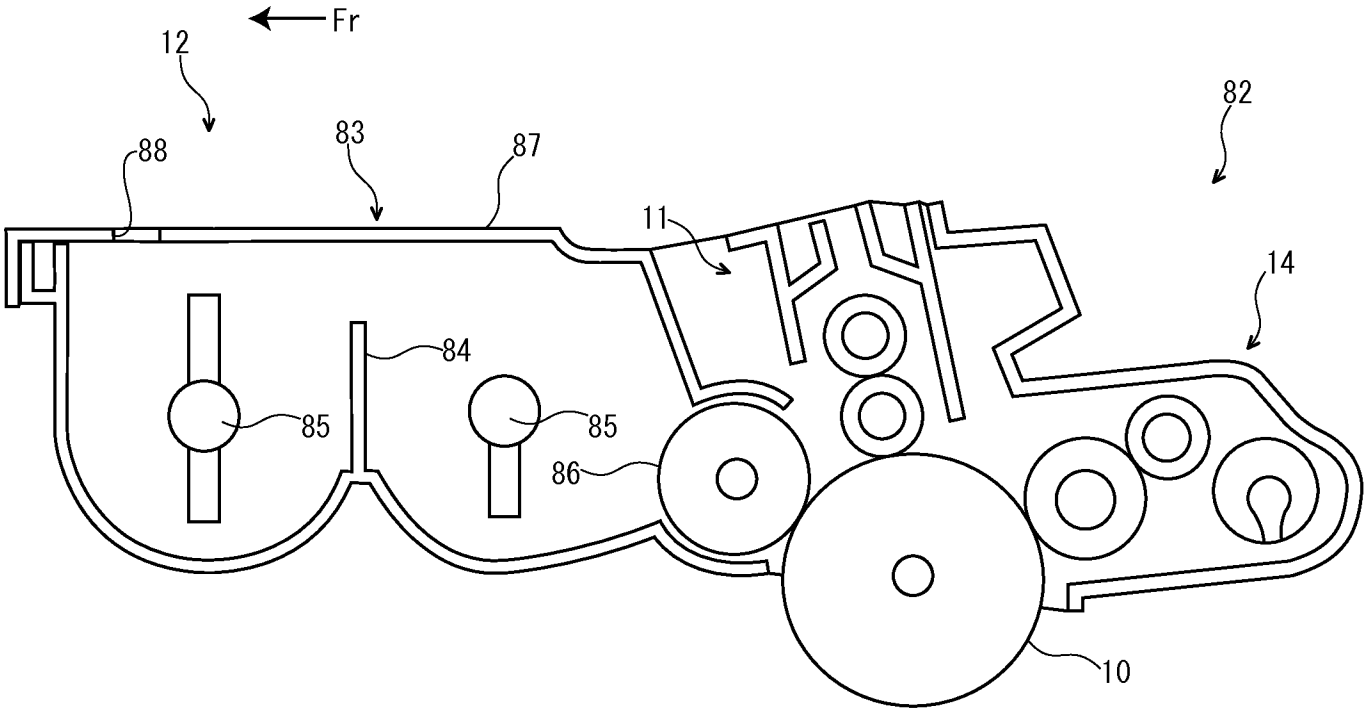
FIG. 8 is a schematic diagram schematically showing an image forming unit in the printer according to the first embodiment of the present disclosure.

Arrow Fr suitably put on each figure indicates the front side of the printer 1 (FIG. 8 and more are also illustrated similarly). As FIG. 2 is the back perspective sectional view, the left-hand and right-hand sides of the figure are converse to the actual left and right sides. That is, the right-hand side of FIG. 2 is correspondent to the left side of the toner container 6 and the left-hand side of FIG. 2 is correspondent to the right side of the toner container 6.

As shown in FIG. 1, the toner container 6 is located below the upper cover 5 of the printer main body 2. The toner container 6 is detachably installed to the development device 12. For instance, when the toner is exhausted, the toner container 6 is made replaceable by opening the upper cover 5 (refer to two-dot chain line on FIG. 1).

As shown in FIG. 2 and other figure, the toner container 6 includes a box-formed container main body 22 with a opened top surface, a conveying screw 23, a stirring paddle 24, a covering body 25, a lever 26, a transmitting member 27 and a container side shutter 28. The conveying screw 23 is installed in a lower rear part of the container main body 22. The stirring paddle 24 is installed near a center part of the container main body 22. The covering body 25 covers the top surface of the container main body 22. The lever 26 is attached to a right end of the container main body 22. The transmitting member 27 is placed on the right end of the container main body 22 together with the lever 26. The container side shutter 28 is attached as a pressing member to a right bottom end of the container main body 22. The transmitting member 27 is illustrated in FIGS. 2 and 6 but omitted in the remaining figures.

The container main body 22 is formed in an extended-shape in left and right directions or a horizontal direction to contain the toner. On a left end wall 30 of the container main body 22, a toner filling port 31 is formed and the toner filling port 31 is closed by a cap 32. On the circumference of a top end of the container main body 22, a main body side flange 33 is formed.

At the right bottom end of the container main body 22, a cylinder-formed discharging duct 34 is protruded to a right direction and, on a right end of the discharging duct 34, an aperture 36 is formed. As shown in FIG. 3 and other figure, in a bottom of the discharging duct 34, a discharge port 35 configured to discharge the toner is bored. On the circumference of a lower part of the discharging duct 34, a sealing member 37 is attached and, in the sealing member 37, a communication port 38 is bored at a correspondent position to the discharge port 35.

As shown in FIG. 4, at the center of a right end wall 40 of the container main body 22, a cylinder-formed boss 42 is protruded to aright direction (an outside direction). The boss 42 is penetrated with a communicating hole 41. On aright surface (an outside surface) of the right end wall 40 of the container main body 22, a first restrain rib 43 is protruded to an upper backward direction of the boss 42. On the right surface of the right end wall 40 of the container main body 22, a second restrain rib 44 is protruded to an upper forward direction of the boss 42. An upper part of the second restrain rib 44 is depressed so that a depression 45 is formed. On the right surface of the right end wall 40 of the container main body 22, a cylinder-formed protrusion 46 is formed below the first restrain rib 43.

As shown in FIG. 2 and other figure, the conveying screw 23 is formed in an extended-shape in the horizontal direction. The conveying screw 23 includes a bar-formed rotating shaft and a spiral fin 48 concentrically mounted on the circumference of the rotating shaft 47. A left end of the rotating shaft 47 is pivotally supported by the left end wall 30 of the container main body 22. Right side parts of the rotating shaft 47 and spiral fin 48 are inserted into the discharging duct 34. A right end of the rotating shaft 47 protrudes from the discharging duct 34 via the aperture 36 to the right direction and, onto the protruding part, a conveying gear 50 is fixedly attached.

The stirring paddle 24 is located below and in front of the conveying screw 23 and formed in an extended-shape in the horizontal direction. The stirring paddle 24 includes a frame plate-formed supporting frame 51 and a sheet-formed stirring fin 52 supported by the supporting frame 51. Left and right ends (both horizontal ends) of the supporting frame 51 are pivotally supported by the left end wall 30 and right end wall 40 of the container main body 22 via bearings 49 (refer to FIG. 3, hereinafter, it is called as "a bearing 49 of a stirring paddle 24"). As shown in FIG. 4 and other figure, on the bearing 49 of the stirring paddle 24 attached onto the right end wall 40, an engaging reception 53 is formed at a correspondent position to the communication hole 41 of the boss 42.

The stirring fin 52 is formed out of plastic sheet, e.g. lumirror. As shown in FIG. 2 and other figure, one side of the stirring fin 52 is fixedly attached onto the supporting frame 51 along the horizontal direction. The stirring fin 52 is provided with a plurality of slits 54.

On a bottom end of the covering body 25, a covering body side flange 55 is formed in the correspondent form to the main body side flange 33 of the container main body 22. The main body side flange 33 and covering body side flange 55 are ultrasonic-welded together so that the container main body 22 and covering body 25 are unified. In a center of the horizontal direction of the covering body 25, a hollow 56 is formed.

As shown in FIG. 4 and other figure, the lever 26 includes a lever main body 57 with a circular profile in a side view. The lever main body 57 includes a small-diameter cylinder 58, a large-diameter cylinder 60 attached around the circumference of the small-diameter cylinder 58 and four radially extended connectors 61 of connecting the small-diameter cylinder 58 and large-diameter cylinder 60 with each other. The small-diameter cylinder 58 is fitted onto the circumference of the boss 42 arranged on the right end wall 40 of the container main body 22. Accordingly, the lever 26 is rotatably supported onto the container main body 22.

On an upper part of the large-diameter cylinder 60, a gripper 62 is protruded. A top end of the gripper 62 extends to the right side of the covering body 25. In the gripper 62, forward tilted angle is restricted by the second restrain rib 44 (refer to FIG. 4) and backward tilted angle is restricted by the first restrain rib 43 (refer to FIG. 5). On an upper part of the large-diameter cylinder 60, a protruding piece 63 is formed in front of the gripper 62. As shown in FIG. 5, the protruding piece 63 engages with the depression 45 of the second restrain rib 44 in a state that the gripper 62 is tilted backward. On the circumference of a lower rear part of the large-diameter cylinder 60, a lever side gear 64 is formed.

As shown in FIG. 6 and other figure, the transmitting member 27 includes a disc-formed transmitting member main body 65. On a right surface (an outside surface) of the transmitting member main body 65, a transmission coupling 66 is protruded in the form of a triangle pole in a side view. On a left surface (an inside surface) of the transmitting member main body 65, an engaging piece 67 is protruded. The engaging piece 67 is inserted into the communication hole 41 bored in the boss 42 of the container main body 22, and then, engaged with the engaging reception 53 (refer to FIG. 4 and other figure) formed on the bearing 49 of the stirring paddle 24. Accordingly, the transmitting member 27 and stirring paddle 24 are connected with each other to rotate in a body.

As shown in FIG. 6, on the circumference of the transmitting member main body 65, a transmission gear 68 is formed. The transmission gear 68 meshes with the conveying gear 50 fixedly attached onto the rotating shaft 47 of the conveying screw 23, thereby rotating the conveying screw 23 in accordance with the rotation of the transmitting member 27. In FIG. 6, the conveying gear 50 and rotating shaft 47 are illustrated in the separated state from each other.

The container side shutter 28 is formed in a cylinder-liked shape and rotatably fitted onto the circumference of the discharging duct 34 of the container main body 22. In a lower surface of the container side shutter 28, a discharge aperture 70 is bored. As shown in FIG. 3 and other figure, the discharge aperture 70 is formed at a correspondent position to the discharge port 35 of the container main body 22 and the communication port 38 of the sealing member 37.

As shown in FIG. 4 and other figure, on the container side shutter 28, a roughly fan-formed guiding piece 71 is protruded forward. In the guiding piece 71, an arc-formed guiding hole 72 is formed and, with the guiding hole 72, the protrusion 46 of the container main body 22 is engaged.

As shown in FIG. 2 and other figure, in the container side shutter 28, a cylinder-formed bearing 73 is formed and, into the bearing 73, the right end of the rotating shaft 47 of conveying screw 23 is pivotally supported. On a right side part of the bearing 73, a gear box 74 is attached and the gear box 74 houses the conveying gear 50. As shown in FIG. 7 and other figure, in the gear box 74, a communication aperture 75 is formed, and then, it is possible to house the conveying gear 50 in the gear box 74 via the communication aperture 75.

The container side shutter 28 is provided with a shutter side gear 76. The shutter side gear 76 meshes with the lever side gear 64 of the lever 26, thereby turning the container side shutter 28 in the opposite direction to the lever 26 in accordance with the turn of the lever 26. On the right end of the container side shutter 28, a locking piece 77 is attached. The locking piece 77 includes a pair of plane parts 78 facing to each other and a pair of curving parts 79, each of which is connected with respective ends of the plane parts 78. The locking piece 77 is formed with an elliptic section. Outside of a lower part of the container side shutter 28, a pressing protrusion 80 is formed at the right side of the discharge aperture 70 and a window 81 is formed above the pressing protrusion 80.

Figure 9:
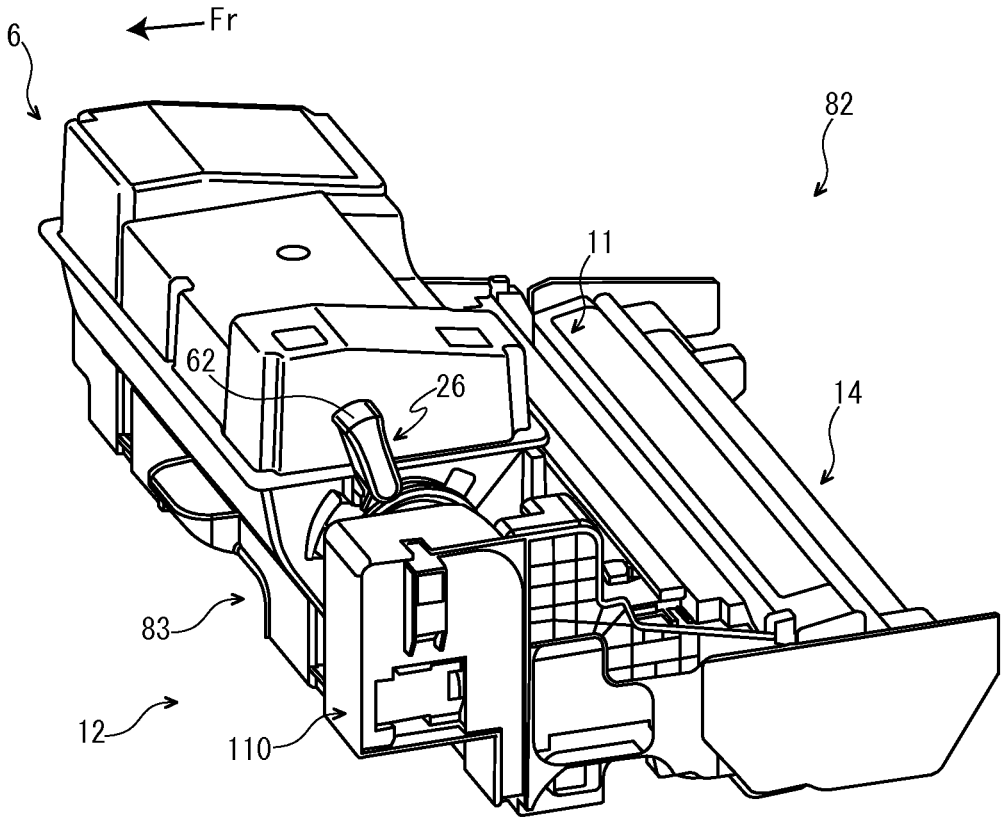
FIG. 9 is a front right perspective view showing the toner container in a situation of being installed into a development device in the printer according to the first embodiment of the present disclosure.
Figure 10:
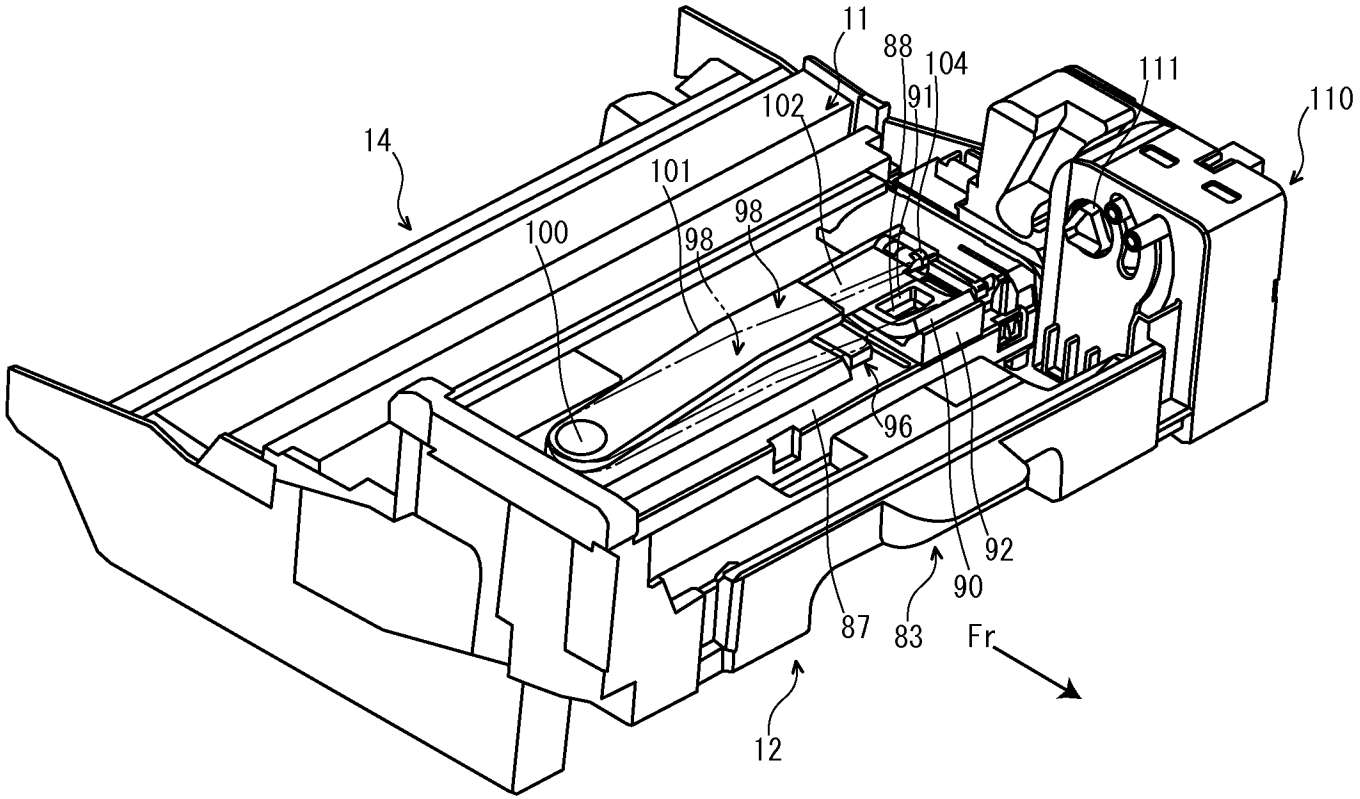
FIG. 10 is a front left perspective view showing the image forming unit in the printer according to the first embodiment of the present disclosure.
Figure 11:
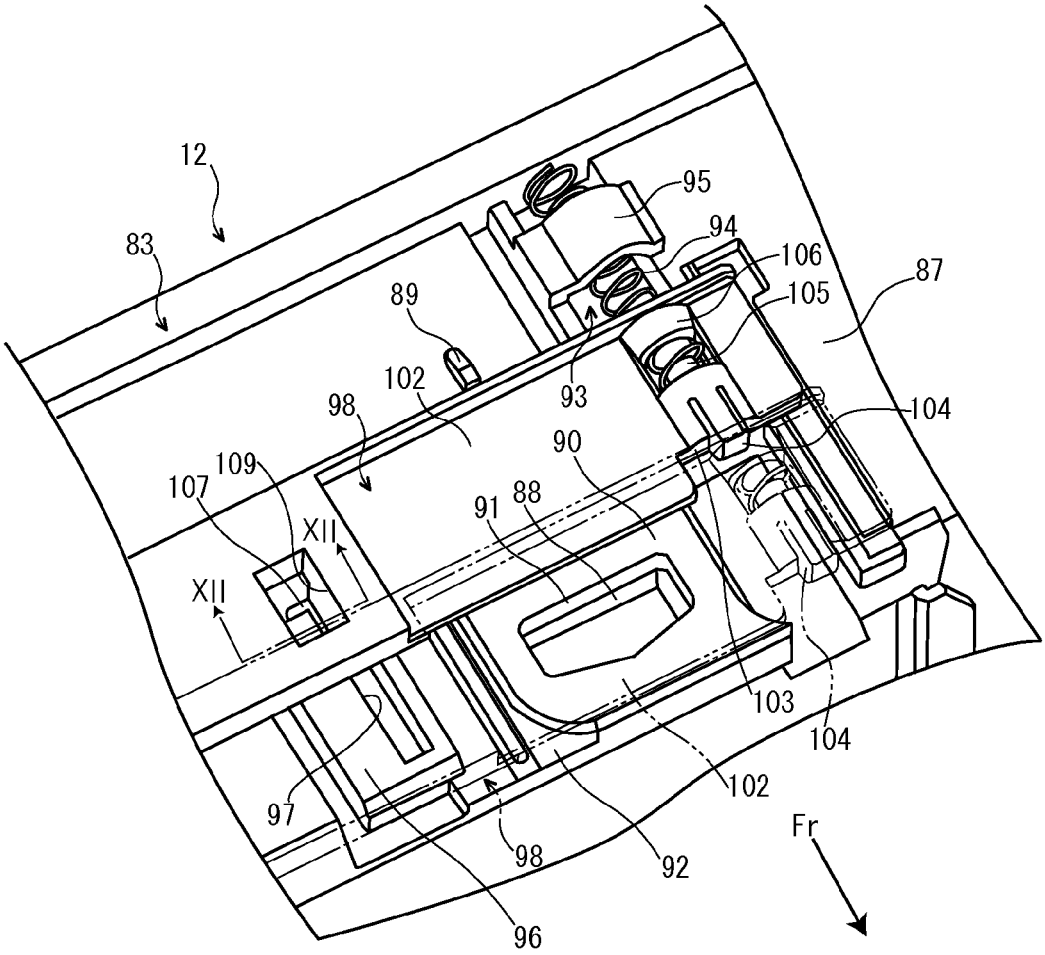
FIG. 11 is a perspective view showing the replenishment port and its circumference in the development device of the printer according to the first embodiment of the present disclosure.
Figure 12:
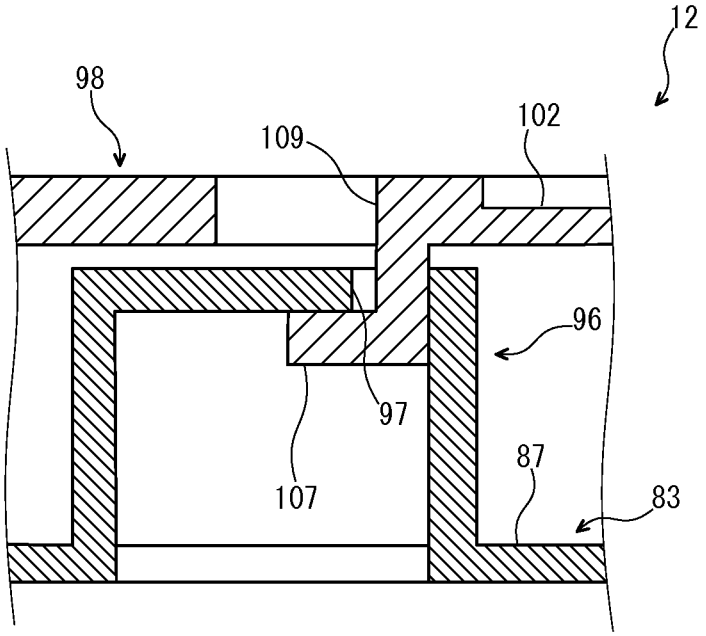
FIG. 12 is a sectional view along a XII-XII line of FIG. 11.
Figure 13:
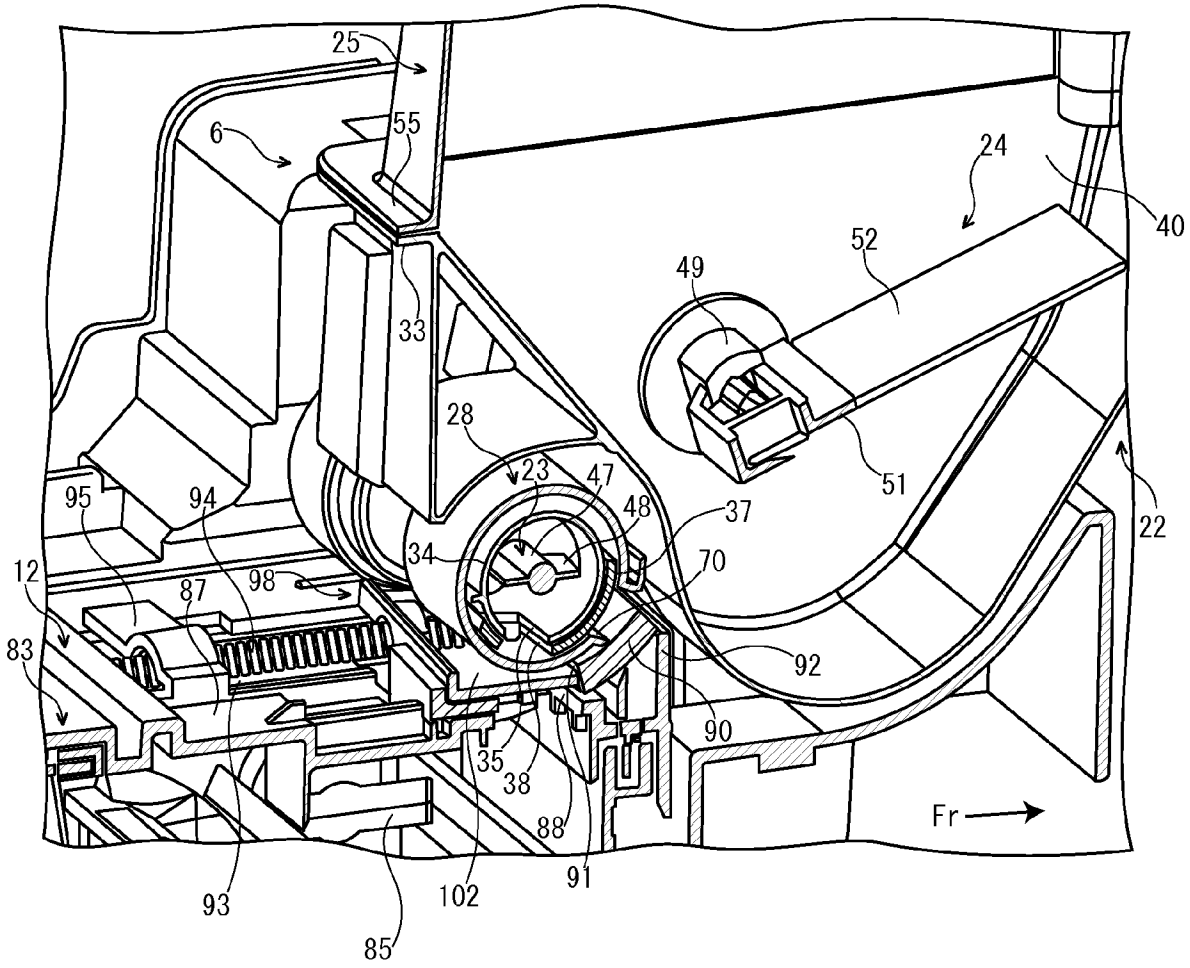
FIG. 13 is a back left perspective sectional view showing the printer in a situation, in which the container side shutter closes the discharge port and the development device side shutter closes the replenishment port, according to the first embodiment of the present disclosure.

Next, with reference to FIGS. 3 and 8-13, the development device 12 will be described in detail. As mentioned above, FIG. 3 is a back left perspective sectional view showing the printer in a situation, in which the container side shutter opens a discharge port and a development device side shutter opens a replenishment port, according to the first embodiment of the present disclosure. FIG. 8 is a schematic diagram schematically showing an image forming unit in the printer according to the first embodiment of the present disclosure. FIG. 9 is a front right perspective view showing the toner container in a situation of being installed into the development device in the printer according to the first embodiment of the present disclosure. FIG. 10 is a front left perspective view showing the image forming unit in the printer according to the first embodiment of the present disclosure. FIG. 11 is a perspective view showing the replenishment port and its circumference in the development device of the printer according to the first embodiment of the present disclosure. FIG. 12 is a sectional view along a XII-XII line of FIG. 11. FIG. 13 is a back left perspective sectional view showing the printer in a situation, in which the container side shutter closes the discharge port and the development device side shutter closes the replenishment port, according to the first embodiment of the present disclosure.

As shown in FIG. 8, the development device 12 is integrated with the photosensitive drum 10, charger 11 and cleaning device 14 so that an image forming unit 82 is composed. The development device 12 is provided with a box-formed development device main body 83. At the center inside the development device main body 83, a partition 84 extending in upper and lower directions or a perpendicular direction is formed and, in front and behind the partition 84, stirring members 85 are respectively installed. Each stirring member 85 is rotatably supported onto the development device main body 83. Inside the development device main body 83, below and behind the rear stirring member 85, a developing roller 86 is installed. The developing roller 86 is rotatably supported onto the development device main body 83 and comes into contact with the surface of the photosensitive drum 10. As shown in FIG. 9, on the top surface side of the development device main body 83, the toner container 6 is detachably installed.

As shown in FIG. 3 and other figure, in a top wall 87 of the development device main body 83, a replenishment port 88 is bored in the perpendicular direction. On a top surface of the top wall 87 of the development device main body 83 (a part of an outside face of the development device main body 83), a sealing member 90 is fixedly attached around the replenishment port 88. The sealing member 90 is made of elastic material, e.g. sponge. As shown in FIGS. 10 and 11, in the sealing member 90, a replenishment aperture 91 is formed at a correspondent position to the replenishment port 88 of the development device main body 83. A front end of the sealing member 90 is placed on a pedestal 92 and formed in an arc shape curved in an upper forward direction. The pedestal 92 is protruded on the top wall 87 of the development device main body 83.

As shown in FIG. 11, on a top surface of the top wall 87 of the development device main body 83, a restricting protrusion 89 is protruded behind the sealing member 90. On the top surface of the top wall 87 of the development device main body 83, a spring house 93 is formed at the right side of the sealing member 90 along forward and backward directions. In the spring house 93, a coil spring 94 as a biasing member is housed and a rear end of the coil spring 94 comes into contact with a back face of the spring house 93. The rear of the coil spring 94 is covered from above by an arch-formed spring holding piece 95. The spring holding piece 95 is bridged above the spring house 93.

On the top surface of the top wall 87 of the development device main body 83, an engaging portion 96 is bridged at the left side of the sealing member 90 along the forward and backward directions. In the engaging portion 96, an engaging gap 97 is formed along the forward and backward directions (refer to FIG. 12).

As shown in FIG. 10 and other figure, at the top surface side of the top wall 87 of the development device main body 83, a development device side shutter 98 is attached. The development device side shutter 98 is formed in an extended plane-liked shape in the horizontal direction. At a left end of the development device side shutter 98, a supporting pivot 100 is provided. The development device side shutter 98 is adapted to turn around the supporting pivot 100 in a forward or backward direction along the top surface side of the top wall 87 of the development device main body 83. The center part in the horizontal direction of the development device side shutter 98 is gently bent as a bend part 101.

As shown in FIG. 11, on a right side part of the development device side shutter 98, a thin opening/closing part 102 is provided. A bottom surface of the opening/closing part 102 comes into contact with a top surface of the sealing member 90. In accordance with the turn of the development device side shutter 98 around the supporting pivot 100, the opening/closing part 102 opens or closes the replenishment port 88 of the development device main body 83 and the replenishment aperture 91 of the sealing member 90. Hereinafter, one position of the opening/closing part 102, in a case where the replenishment port 88 of the development device main body 83 and the replenishment aperture 91 of the sealing member 90 are opened (refer to FIG. 3), is called as an opening position of the opening/closing part 102. Another position of the opening/closing part 102, in a case where the replenishment port 88 of the development device main body 83 and the replenishment aperture 91 of the sealing member 90 are closed (refer to FIG. 11), is called as a closing position of the opening/closing part 102. The bend part 101 is formed between the supporting pivot 100 and opening/closing part 102.

As shown in FIG. 11, in the development device side shutter 98, a rectangle-formed notch 103 is formed at the right side of the opening/closing part 102 and, from the notch 103, a contact piece 104 is protruded. As shown in FIG. 10, the contact piece 104 is located at a position further away from the supporting pivot 100 than the opening/closing part 102.

As shown in FIG. 11, behind the contact piece 104, a spring bearing 105 is attached. On the spring bearing 105, a front end of the coil spring 94 is attached, thereby biasing the opening/closing part 102 of the development device side shutter 98 to the closing position. In the development device side shutter 98, an arch-formed spring holder 106 is provided in the rear of the spring bearing 105 so that the coil spring 94 is covered from above by the spring holder 106.

As shown in FIG. 12, in the development device side shutter 98, a communication hole 109 is bored at the left side of the opening/closing part 102 and an L-shaped hook 107 is protruded from the communication hole 109 toward the development device main body 83 (in a lower direction in the first embodiment). The hook 107 is inserted into the engaging gap 97 formed in the engaging portion 96 of the development device main body 83 to engage with the engaging portion 96.

As shown in FIG. 10, on the right end side of the development device main body 83, a driving mechanism 110 is installed. The driving mechanism 110 includes a drive coupling 111 in the form of a triangle pole in a side view. The drive coupling 111 is connected with a drive unit (not shown), such as a motor.

In the apparatus configured as mentioned above, as shown in FIG. 9, the toner container 6 is attached onto the development device 12 in a state that the gripper 62 of the lever 26 is tilted forward. Accordingly, as shown in FIG. 4, the pressing protrusion 80 of the container side shutter 28 comes into contact with the contact piece 104 of the development device side shutter 98. At this moment, as shown in FIG. 13, the discharge port 35 of the container main body 22 is closed by the container side shutter 28 and the replenishment port 88 of the development device main body 83 is closed by the opening/closing part 102 of the development device side shutter 98. Therefore, the communication between the inside of the container main body 22 and the inside of the development device side shutter 98 is interrupted.

In such a situation, as indicated with an arrow Y in FIG. 4, when the worker, such as a user or a serviceman, tilts the gripper 62 of the lever 26 backward, the lever 26 turns in one direction (a clockwise direction on the plane of the figure) around the boss 42 of the container main body 22 (refer to FIG. 5). Accompanying to the turn, as indicated with an arrow Z in FIG. 4, the container side shutter 28 connected with the lever 26 turns another direction (a counter clockwise direction on the plane of the figure) on the container main body 22 (refer to FIG. 5). By the turn of the container side shutter 28, as shown in FIG. 3, the discharge aperture 70 of the container side shutter 28 moves just below the discharge port 35 of the container main body 22 and the communication port 38 of the sealing member 37. That is, the container side shutter 28 opens the discharge port 35 of the container main body 22.

In accordance with the turn of the container side shutter 28 as mentioned above, as shown in FIGS. 4 and 5, the pressing protrusion 80 of the container side shutter 28 presses the contact piece 104 of the development device side shutter 98 backward. Accompanying to the pressure, the development device side shutter 98 turns around the supporting pivot 100 backward and, as shown in FIG. 3, the opening/closing part 102 of the development device side shutter 98 is displaced from the closing position to the opening position. That is, the development device side shutter 98 opens the replenishment port 88 of the development device main body 83. Thus, when the discharge port 35 of the container main body 22 and the replenishment port 88 of the development device main body 83 are opened, the inside of the container main body 22 and the inside of the development device main body 83 are communicated with each other.

In addition, accompanying to the turn of the lever 26 as mentioned above, the drive coupling 111 is connected with the transmission coupling 66. In this situation, when the drive unit, such as the motor, connected with the drive coupling 111 drives to create rotation, the rotation is transmitted to the transmitting member 27 via the drive coupling 111 and transmission coupling 66, and then, the transmitting member 27 rotates. When the transmitting member 27 thus rotates, the stirring paddle 24 connected with the transmitting member 27 rotates, and then, the toner in the container main body 22 is stirred with being conveyed to the side of conveying screw 23. In addition, when the transmitting member 27 rotates as mentioned above, the rotation is transmitted to the rotating shaft 47 of conveying screw 23 via the transmission gear 68 and conveying gear 50, and then, the conveying screw 23 rotates. Accompanying to this, the toner in the container main body 22 is discharged from the discharge port 35 and introduced into the development device main body 83 via the replenishment port 88. The toner introduced into the development device main body 83 is stirred by the stirring members 85, conveyed to the developing roller and supplied from the developing roller 86 to the photosensitive drum 10.

In the first embodiment, as mentioned above, the turn-able development device side shutter 98 is used for opening/closing the replenishment port 88. Accordingly, it is possible to apply the structure that the coil spring 94 is provided on one side of the replenishment port 88 (the right side in the embodiment), and simultaneously, to sufficiently secure the operation stability of the development device side shutter 98. Therefore, in comparison with a case where a linearly slidable development device side shutter is used, it is possible to decrease the number of the coil spring 94 and manufacturing costs.

In addition, because the sealing member 90 attached around the replenishment port 88 and coming into contact with the development device side shutter 98 is fixedly attached onto the development device main body 83, it is possible to prevent the toner from leaking between the toner container 6 and development device 12 and to certainly operate the development device side shutter 98. In the development device main body 83, the engaging portion 96 is provided along the turning direction of the development device side shutter 98 and, in the development device side shutter 98 (forward and backward direction), the hook 107 for engaging with the engaging portion 96 is formed to protrude toward the side of the development device main body 83. Therefore, it is possible to prevent the development device side shutter 98 from floating and to securely locate the development device side shutter 98 in close contact with the sealing member 90.

The pressing protrusion 80 of the container side shutter 28 is adapted to press the contact piece 104 positioned further away from the supporting pivot 100 than the opening/closing part 102. It is therefore possible to displace the opening/closing part 102 with smaller force in comparison with a case of pressing the opening/closing part 102 of the development device side shutter 98 by the pressing protrusion 80 of the container side shutter 28 or another case of pressing a part on the development device side shutter 98 nearer to the supporting pivot 100 than the opening/closing part 102 by the pressing protrusion 80 of the container side shutter 28.

Figure 14A:
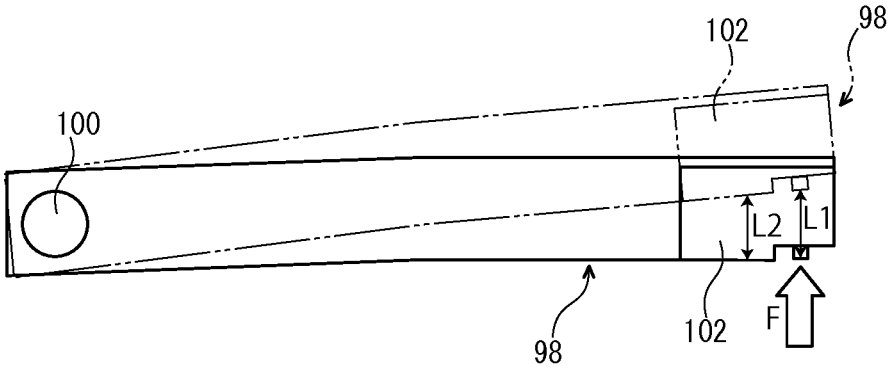
FIG. 14A is a schematic diagram illustrating displacement magnitude of an opening/closing part of the development device side shutter in a situation, in which a position on the development device side shutter further away from a supporting pivot than the opening/closing part is pressed.
Figure 14B:
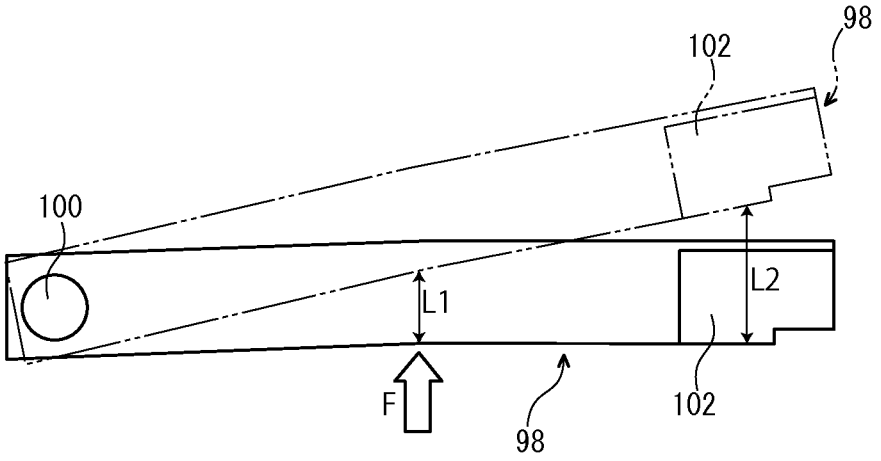
FIG. 14B is a schematic diagram illustrating another displacement magnitude of the opening/closing part of the development device side shutter in another situation, in which another position on the development device side shutter nearer to the supporting pivot than the opening/closing part is pressed.

Alternatively, as another example, the pressing member, such as the container side shutter 28, may press a part on the development device side shutter 98 nearer to the supporting pivot 100 than the opening/closing part 102. Effect in this example will be described with reference to FIGS. 14A and 14B. FIG. 14A is a schematic diagram illustrating displacement magnitude of an opening/closing part of the development device side shutter in a situation, in which one position on the development device side shutter further away from a supporting pivot than the opening/closing part is pressed. FIG. 14B is a schematic diagram illustrating another displacement magnitude of the opening/closing part of the development device side shutter in another situation, in which another position on the development device side shutter nearer to the supporting pivot than the opening/closing part is pressed. The arrows F in FIGS. 14A and 14B indicate positions pressed by the pressing member.

As shown in FIG. 14A, in a case of pressing one part on the development device side shutter 98 further away from a supporting pivot 100 than the opening/closing part 102, displacement magnitude L2 of the opening/closing part 102 is smaller than displacement magnitude L1 of the pressed position on the development device side shutter 98. By contrast, as shown in FIG. 14B, in another case of pressing another part on the development device side shutter 98 nearer to the supporting pivot 100 than the opening/closing part 102 by the pressing member, it is possible to increase the displacement magnitude L2 of the opening/closing part 102 more than the displacement magnitude L1 of the pressed position on the development device side shutter 98. As a further example, the pressing member may press the opening/closing part 102 itself on the development device side shutter 98.

Although the first embodiment was described in a case of pressing the development device side shutter 98 by the rotatable container side shutter 28, as furthermore example, the linear-slidable container side shutter 28 may be applied for pressing the development device side shutter 98. Alternatively, the container main body 22 itself of the toner container 6 may be applied for pressing the development device side shutter 98.

Although the embodiment was described in a case where ideas of the disclosure are applied into the printer 1, as an alternative example, the ideas of the disclosure may be applied into another image forming apparatus except the printer 1, such as a copying machine, a facsimile or a multifunction machine.

Second Embodiment

Figure 15:
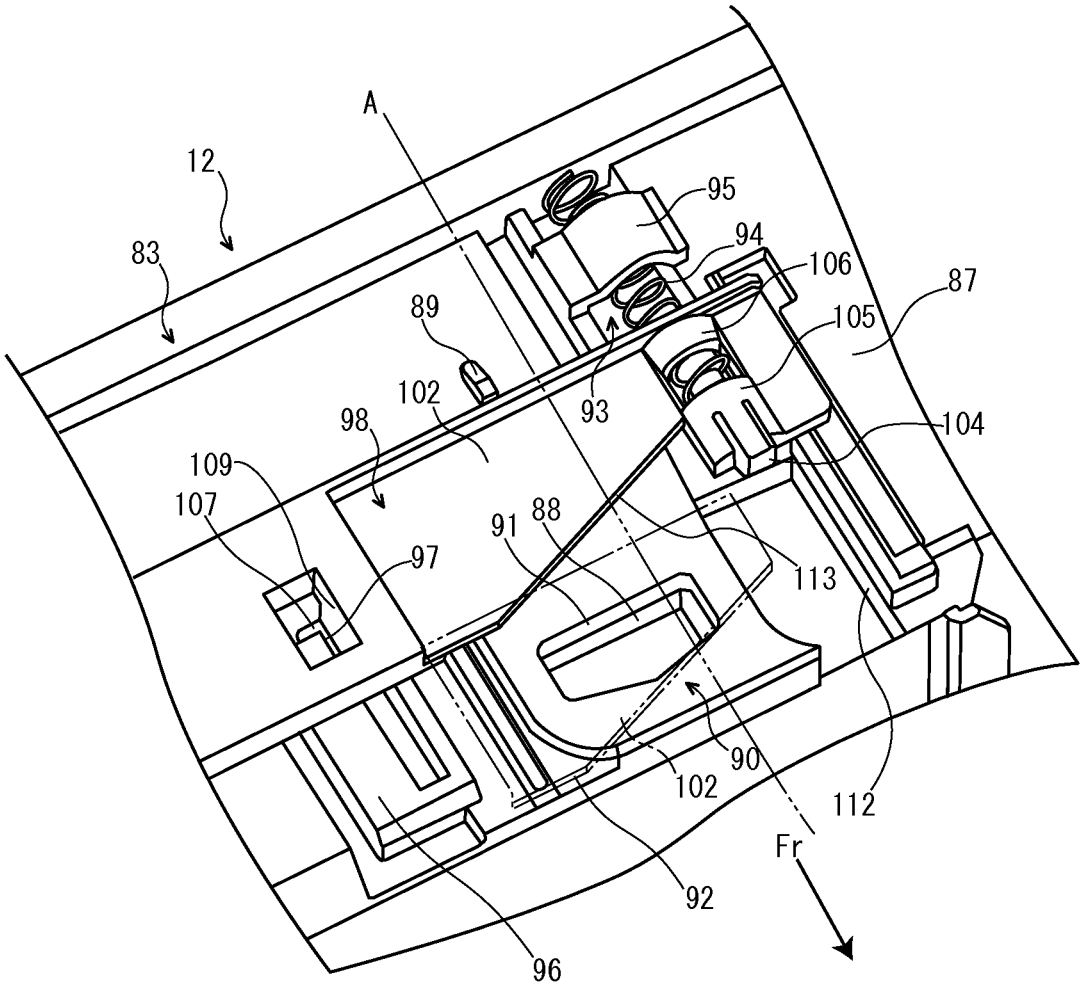
FIG. 15 is a perspective view showing a replenishment port and its circumference in a development device of a printer according to a second embodiment of the present disclosure.
Figure 16:
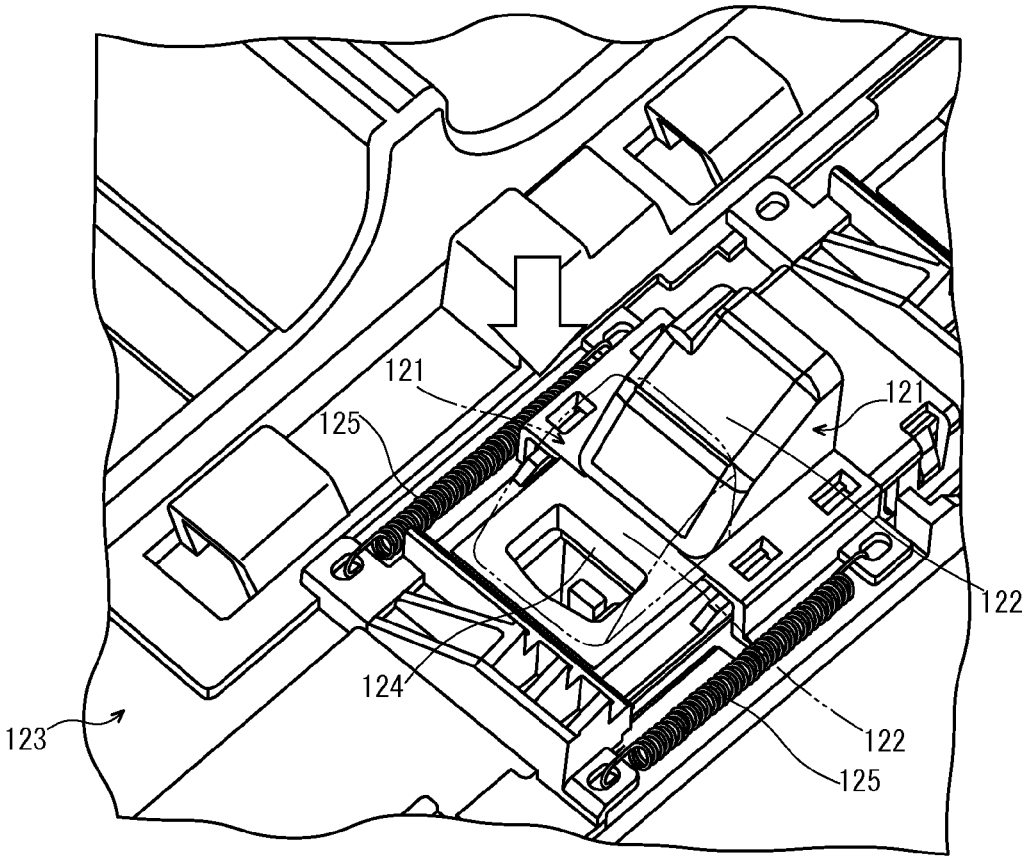
FIG. 16 Related Art
FIG. 16 is a perspective view illustrating a configuration of a shutter.

Next, with reference to FIG. 15, a second embodiment of the present disclosure will be described. FIG. 15 is a perspective view showing a replenishment port and its circumference in a development device of a printer according to the second embodiment of the present disclosure. In the second embodiment, like components or elements are designated with identical reference numerals and repetitive descriptions thereon may be refrained from.

A top face of the top wall 87 of the development device main body 83 is depressed so that a gap-formed toner collecting part 112 is formed adjacent to the replenishment port 88 of the development device main body 83. The toner collecting part 112 is formed in a rectangular shape.

On the front edge of the opening/closing part 102 of the development device side shutter 98, a toner conveying part 113 is formed so as to be inclined to a right backward direction. The toner conveying part 113 is inclined in a turning direction of the development device side shutter 98 (forward and backward directions in the second embodiment; refer to two-dot chain line A in FIG. 15).

In such a configured apparatus, when the opening/closing part 102 moves from the opening position to the closing position (refer to two-dot chain line in FIG. 15) accompanying to the turn of the development device side shutter 98, a toner adhered on the circumference of the replenishment port 88 is conveyed to the toner collecting part 112 by the toner conveying part 113.

By applying such a configuration, it is possible to prevent the toner from dirtying the circumference of the replenishment port 88 without arranging a cleaning member for the circumference of the replenishment port 88 separated from the development device side shutter 98.

Although the second embodiment was described in a case of forming the toner collecting part 112 at the right side of the replenishment port 88 (one side far away from the supporting pivot 100 on the development device side shutter 98), as another example, the toner collecting part 112 may be formed at the left side of the replenishment port 88 (another side near the supporting pivot 100 on the development device side shutter 98). In the latter, the toner conveying part 113 may be inclined to a left backward direction.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner container including a container main body that is provided with a discharge port configured to discharge a toner;

a development device including a development device main body having a replenishment port configured to receive a toner discharged from the discharge port and a shutter configured to open/close the replenishment port;

a sealing member attached onto the circumference of the replenishment port to come into contact with the shutter;

a biasing member configured to bias the shutter to a position to close the replenishment port; and a pressing member configured to press the shutter against the bias force of the biasing member to another position to open the replenishment port;

wherein the shutter is configured to open/close the replenishment port by turning along the outside face of the development device main body.

2. The image forming apparatus according to claim 1, wherein the shutter includes a supporting pivot as the center of its turn and an opening/closing part configured to open/close the replenishment port in accordance with the turn around the supporting pivot, and the pressing member is configured to press a part on the shutter further away from the supporting pivot than the opening/closing part.

3. The image forming apparatus according to claim 2, wherein between the supporting pivot and opening/closing part, a bend part is formed.

4. The image forming apparatus according to claim 1, wherein the shutter includes a supporting pivot as the center of its turn and an opening/closing part configured to open/close the replenishment port in accordance with the turn around the supporting pivot, and the pressing member is configured to press a part on the shutter nearer to the supporting pivot than the opening/closing part.

5. The image forming apparatus according to claim 4, wherein between the supporting pivot and opening/closing part, a bend part is formed.

6. The image forming apparatus according to claim 1, wherein the development device main body has an engaging portion along a turning direction of the shutter, and the shutter has a hook protruding toward the development device main body to engage with the engaging portion.

7. The image forming apparatus according to claim 1, wherein the sealing member is made of sponge.

8. The image forming apparatus according to claim 1, wherein the biasing member is a coil spring.

9. The image forming apparatus according to claim 1, wherein the pressing member is a container side shutter rotatably attached onto the container main body to open/close the discharge port.

10. The image forming apparatus according to claim 9, wherein the container side shutter is configured in a cylinder-liked shape to have a pressing protrusion on its circumference so that the pressing protrusion presses the shutter.

11. An image forming apparatus comprising:

a toner container including a container main body that is provided with a discharge port configured to discharge a toner;

a development device including a development device main body having a replenishment port configured to receive a toner discharged from the discharge port and a shutter configured to open/close the replenishment port;

wherein the development device main body has a toner collecting part adjacent to the replenishment port, the shutter has a toner conveying part along a direction crossing its turning direction, and the apparatus is configured to convey the toner adhered on the circumference of the replenishment port to the toner collecting part by the toner conveying part when the shutter turns; and the shutter is configured to open/close the replenishment port by turning along the outside face of the development device main body.

12. A development device, comprising:

a development device main body having a replenishment port configured to receive a toner;

a shutter configured to open/close the replenishment port, a sealing member attached onto the circumference of the replenishment port to come into contact with the shutter;

a biasing member configured to bias the shutter to a position to close the replenishment port; and a pressing member configured to press the shutter against the bias force of the biasing member to another position to open the replenishment port;

wherein the shutter is configured to open/close the replenishment port by turning along the outside face of the development device main body.

13. The development device according to claim 12, wherein the shutter includes a supporting pivot as the center of its turn and an opening/closing part configured to open/close the replenishment port in accordance with the turn around the supporting pivot, and the pressing member is configured to press a part on the shutter further away from the supporting pivot than the opening/closing part.

14. The development device according to claim 12, wherein the shutter includes a supporting pivot as the center of its turn and an opening/closing part configured to open/close the replenishment port in accordance with the turn around the supporting pivot, and the pressing member is configured to press a part on the shutter nearer to the supporting pivot than the opening/closing part.

15. The development device according to claim 12, wherein the development device main body has a toner collecting part adjacent to the replenishment port, the shutter has a toner conveying part along a direction crossing its turning direction, and the apparatus is configured to convey the toner adhered on the circumference of the replenishment port to the toner collecting part by the toner conveying part when the shutter turns.

16. The development device according to claim 12, wherein the development device main body has an engaging portion along a turning direction of the shutter, and the shutter has a hook protruding toward the development device main body to engage with the engaging portion.

* * * * *